US008616300B2

(12) United States Patent
Suzuki et al.

(10) Patent No.: US 8,616,300 B2
(45) Date of Patent: Dec. 31, 2013

(54) POWER TOOL HAVING AN ILLUMINATOR

(75) Inventors: Jiro Suzuki, Anjo (JP); Hirokatsu Yamamoto, Anjo (JP); Takuya Kusakawa, Anjo (JP)

(73) Assignee: Makita Corporation, Anjo-shi (JP)

( * ) Notice: Subject to any disclaimer, the term of this patent is extended or adjusted under 35 U.S.C. 154(b) by 596 days.

(21) Appl. No.: 12/457,092

(22) Filed: Jun. 1, 2009

(65) Prior Publication Data

US 2009/0309519 A1 Dec. 17, 2009

(30) Foreign Application Priority Data

Jun. 16, 2008 (JP) ..... 2008-156683

(51) Int. Cl.
*E02F 9/20* (2006.01)

(52) U.S. Cl.
USPC ..... 173/46; 173/2; 362/119

(58) Field of Classification Search
USPC ..... 173/2, 46; 362/119
See application file for complete search history.

(56) References Cited

U.S. PATENT DOCUMENTS

| | | | | |
|---|---|---|---|---|
| 2,310,166 | A | 2/1943 | Way | |
| 2,525,588 | A | 10/1950 | Cameron et al. | |
| 4,642,738 | A | 2/1987 | Meller | |
| 5,412,546 | A | 5/1995 | Huang | |
| 6,206,538 | B1 * | 3/2001 | Lemoine | 362/119 |
| 6,318,874 | B1 | 11/2001 | Matsunaga | |
| 6,511,200 | B2 * | 1/2003 | Matsunaga | 362/119 |
| 6,796,921 | B1 * | 9/2004 | Buck et al. | 475/299 |
| 7,893,586 | B2 * | 2/2011 | West et al. | 310/140 |
| 2004/0187313 | A1 * | 9/2004 | Zirk et al. | 30/123 |
| 2005/0157489 | A1 * | 7/2005 | Oomori et al. | 362/119 |
| 2007/0159812 | A1 | 7/2007 | Oomori et al. | |
| 2011/0199756 | A1 | 8/2011 | Oomori et al. | |
| 2012/0033405 | A1 | 2/2012 | Oomori et al. | |

FOREIGN PATENT DOCUMENTS

| | | |
|---|---|---|
| DE | 38 31 344 A1 | 3/1990 |
| JP | A-10-034564 | 2/1998 |
| JP | A-2001-25982 | 1/2001 |
| JP | A-2003-211374 | 7/2003 |
| JP | A-2007-223037 | 9/2007 |

OTHER PUBLICATIONS

Aug. 21, 2012 Office Action issued in Japanese Patent Application No. 2008-156683 w/translation.
May 28, 2013 Office Action issued in Japanese Patent Application No. 2013-089045 w/translation.

* cited by examiner

*Primary Examiner* — Alexandra Elve
*Assistant Examiner* — Nathaniel Chukwurah
(74) *Attorney, Agent, or Firm* — Oliff & Berridge, PLC

(57) ABSTRACT

A power tool of the present teachings comprises a prime mover that drives a tool, a main switch that causes the prime mover to operate when the main switch is turned on and causes the prime mover to stop operating when the main switch is turned off, an illuminator that lights a working area of the tool, and a lighting mode selector switch for switching the lighting mode of the illuminator between a plurality of lighting modes which include a first lighting mode and a second lighting mode. When the first lighting mode is selected, the illuminator will be turned on for a first predetermined period from the point at which the main switch is turned off. When the second lighting mode is selected, the illuminator will not be turned on during the first predetermined period from the point at which the main switch is turned off.

18 Claims, 5 Drawing Sheets

POWER TOOL HAVING AN ILLUMINATOR

CROSS-REFERENCE TO RELATED APPLICATION

This application claims priority to Japanese Patent Application No. 2008-156683, filed on Jun. 16, 2008, the contents of which are hereby incorporated by reference into the present application.

BACKGROUND OF THE INVENTION

1. Field of the Invention

The present invention relates to a power tool. More particularly, the present invention relates to a power tool comprising an illuminator that lights working areas.

2. Description of the Related Art

Japanese Patent Application Publication No. 2001-25982 discloses a power tool comprising an illuminator that lights working areas. With this power tool, the illuminator will be turned on at the point when a main switch is turned on, and the illuminator will be turned off at the end of a predetermined time period from the point that the main switch is turned off.

According to the aforementioned power tool, the illuminator will continue to be on for a predetermined time period after, for example, the work for which the power tool was used is completed, and the main switch is turned off. Because of this, the area on which work operation was performed with the power tool can be illuminated and confirmed with the illuminator after the work for which the power tool was used is completed. Thus, the user will not need to perform a separate task, such as operating a switch, in order to turn on/turn off the illuminator.

BRIEF SUMMARY OF THE INVENTION

There is a variety of different environments in which a power tool is used, and thus there may be times in which the illuminator does not need to be on after the main switch is turned off. However, with the aforementioned power tool, the illuminator will continue to be on for a predetermined time period after the main switch is turned off. Because of this, electric power will be needlessly consumed.

The present teachings aim to solve the aforementioned problem. The present teachings disclose a power tool that prevents the illuminator from being needlessly turned on.

The power tool of the present teachings comprises a prime mover that drives a tool, a main switch that causes the prime mover to operate when the main switch is turned on and causes the prime mover to stop when the main switch is turned off, an illuminator that lights a working area of the tool, and a lighting mode selector switch for switching the lighting mode of the illuminator between a plurality of predetermined lighting modes. The plurality of predetermined lighting modes includes a first lighting mode in which the illuminator is on continuously during a first predetermined period from the point the main switch is turned off, and a second lighting mode in which the illuminator is off during the first predetermined period from the point the main switch is turned off.

This power tool can be set such that the illuminator is turned on after the main switch is turned off, and can be set such that the illuminator is turned off after the main switch is turned off, by operating the lighting mode selector switch. The operating mode of the illuminator can be switched in response to the type of work, the work environment, etc. in which the power tool is to be used, and thus the illuminator can be prevented from being needlessly turned on. In this way, electric power can be prevented from being needlessly consumed by the illuminator.

DETAILED DESCRIPTION OF THE INVENTION

Figure 1:
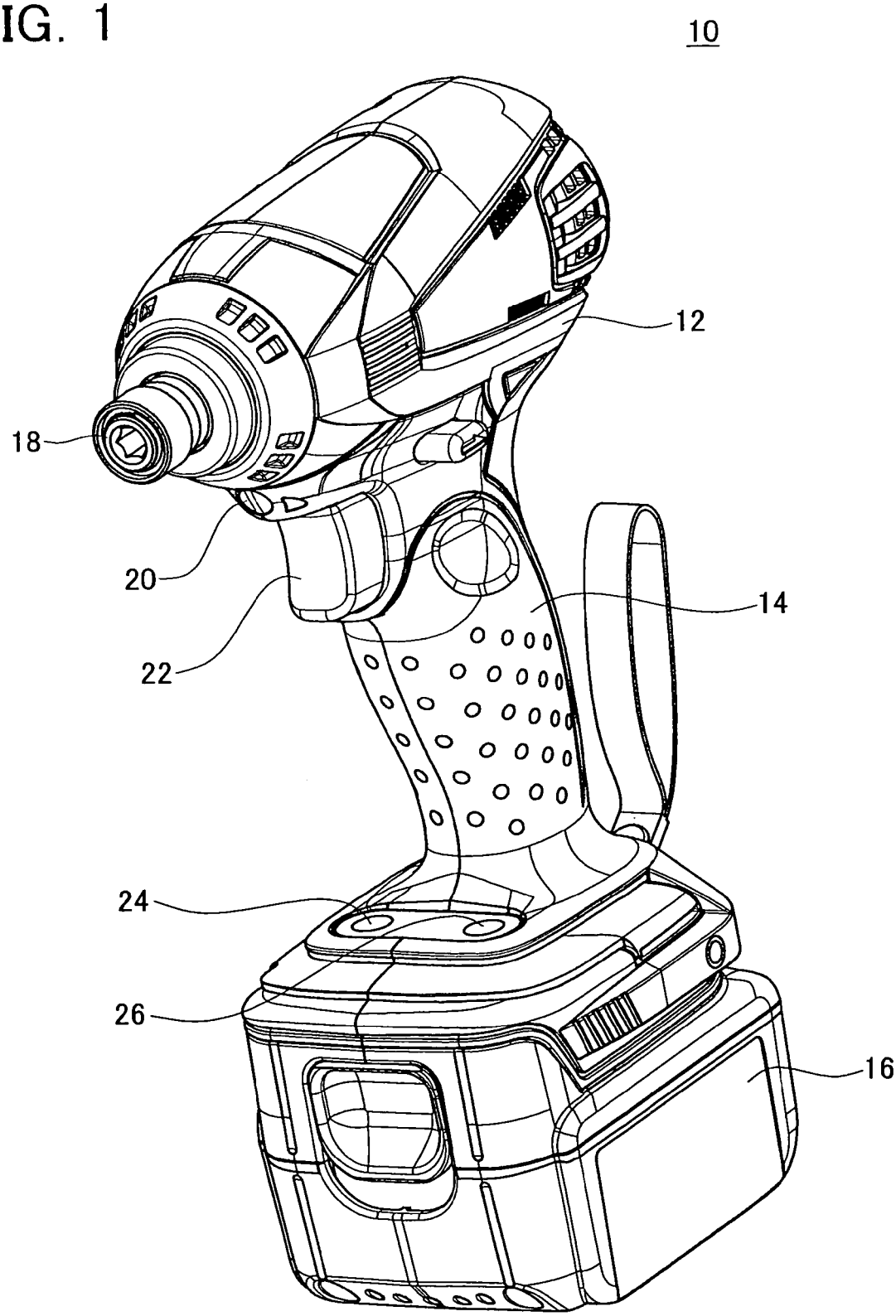
FIG. 1 shows the external appearance of an electric screwdriver.

Preferred Features of Embodiments of the Invention

Preferably, when the first lighting mode is selected, the illuminator will be turned on when the main switch is turned on, and will be turned off after the first predetermined time period from the point the main switch is turned off. Preferably, when the second lighting mode is selected, the illuminator will remain off regardless of whether the main switch is turned on or turned off.

According to this construction, in cases where lighting with the illuminator is not needed, the illuminator can be prevented from being turned on in response to the operation of the main switch by selecting the second lighting mode. Electric power can thus be prevented from being needlessly consumed by the illuminator.

Preferably, the plurality of lighting modes that can be switched in accordance with the mode switch performed by the lighting mode selector switch further includes a third lighting mode, in which the illuminator will preferably be on at the point when the lighting mode is switched to the third lighting mode, and turned off after a second predetermined time period from the point at which the mode switch has occurred.

Here, the second predetermined time period in the third lighting mode may be the same as the first predetermined time period in the first lighting mode, or may be different (i.e. either longer or shorter).

According to this construction, the illuminator can be turned on by simply operating the lighting mode selector switch, and without operating the main switch. In this way, when for example checking the working area in advance, the illuminator can be turned on without needlessly driving the tool.

Preferably, the first predetermined time period and/or the second predetermined time period can be adjusted with the lighting mode selector switch. Preferably, the first predetermined time period and/or the second predetermined time period can be adjusted in accordance with the amount of time that the lighting mode selector switch is continuously operated.

According to this construction, a separate switch for adjusting the lighting period of the illuminator will not be needed. The construction of the power tool can be made comparatively simple.

Preferably, the luminance of the illuminator can be adjusted with the lighting mode selector switch. In this case, it is more preferable that the luminance of the illuminator can be adjusted in accordance with the amount of time that the lighting mode selector switch is continuously operated.

According to this construction, a separate switch for adjusting the luminance of the illuminator will not be needed. The construction of the power tool can be made comparatively simple.

Preferably, the power tool of the present teachings further comprises a mode indicating device that indicates the selection of the first lighting mode to a user when the first lighting mode is selected with the lighting mode selector switch. In this case, the mode indicating device preferably lights the illuminator when the first lighting mode is selected.

According to this construction, a user can confirm whether or not the first lighting mode is selected while operating the lighting mode selection switch.

Preferably, the power tool of the present teachings further comprises a storage device that stores the lighting mode selected with the lighting mode selector switch.

According to this construction, there will be no need to operate the mode selection switch again to reset the lighting mode after temporarily halting the work operation with the power tool.

Preferably, the power tool of the present teachings further comprises a speed selector switch for switching the operating speed of the prime mover among a plurality of predetermined operating speeds. In this case, the storage device stores, for each operating speed that can be selected with the speed selector switch, the lighting mode selected correspondingly with the lighting mode selector switch.

According to this construction, when the operating speed of the prime mover is switched in response to the type of work to be performed by the power tool, the lighting mode will also be automatically switched. A cumbersome operation such as reselecting the lighting mode each time the operating speed of the prime mover is changed will not be needed.

Preferably, switching the lighting mode with the lighting mode selector switch is prohibited while the main switch is turned on.

According to this construction, the illuminator will not be suddenly turned on or turned off even if the lighting mode selection switch is mistakenly operated while work is being performed by the power tool.

The prime mover that drives the tool may be a motor that runs on electricity, an engine that runs on a fuel, or an air pressure motor that is driven by pressurized air, but is preferably a motor that runs on electricity. In this case, the prime mover and the prime mover of the illuminator can be shared.

The illuminator is preferably arranged on the main body of the power tool. However, the illuminator can be arranged on a battery pack that can be removed from the main body of the power tool. However, when the illuminator is arranged on the battery pack, the wiring between the main body and the battery pack may become complicated.

The first lighting mode is a mode in which the illuminator will be on during the first predetermined period from the point the main switch is turned off. Thus, the first lighting mode may, for example, be a lighting mode in which the illuminator is turned on when the main switch is turned on, and turned off after the first predetermined period from the point the main switch is turned off, or a lighting mode in which the illuminator is on at the point the main switch is turned off, and turned off after the first predetermined period from the point the main switch is turned off. In other words, with the first lighting mode, the illuminator may be either turned on or turned off while the main switch is turned on.

The second lighting mode is a mode in which the illuminator is turned off during the first predetermined period from the point the main switch is turned off. Thus, the second lighting mode may, for example, be a lighting mode in which the illuminator remains off regardless of whether the main switch is turned on or turned off, or a lighting mode in which the illuminator is turned on when the main switch is turned on and turned off when the main switch is turned off. In other words, with the second lighting mode, the illuminator may be either turned on or turned off while the main switch is turned on.

Embodiment of the Invention

Embodiment 1

Figure 2:
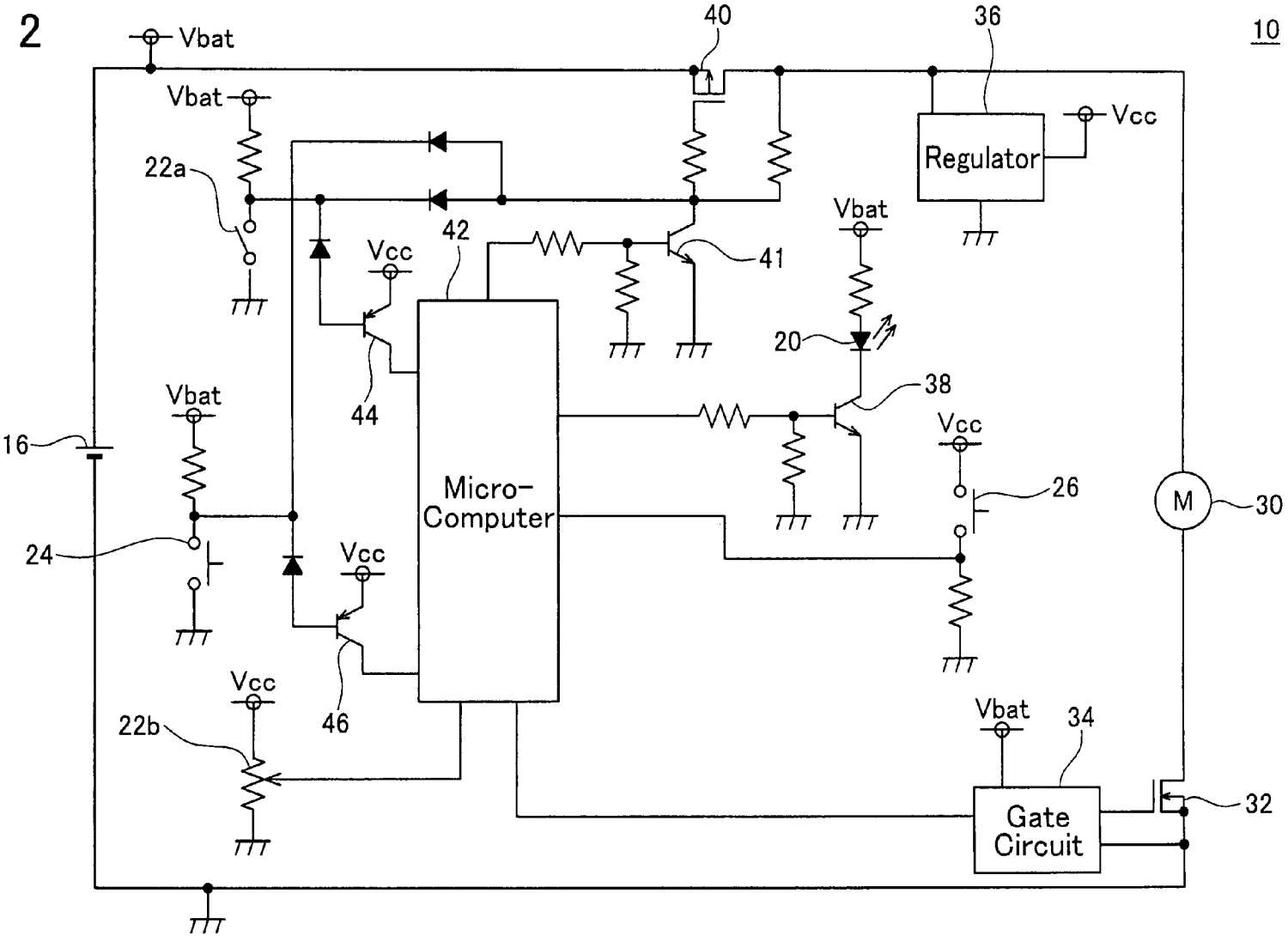
FIG. 2 is a circuit diagram showing the electrical construction of the electric screwdriver.

An electric screwdriver 10 achieved by the present invention will be described with reference to the drawings. FIG. 1 shows the external appearance of the electric screwdriver 10. FIG. 2 shows the electrical structure of the electric screwdriver 10. The electric screwdriver 10 is a portable power tool that is primarily employed to tighten screws.

As shown in FIG. 1, the electric screwdriver 10 comprises a main body 12, and a battery pack 16 that is removably attached to the main body 12. A grip portion 14 for a user to grip is arranged on the main body 12. The battery pack 16 is installed on the end of the grip portion 14. The electric screwdriver 10 operates by means of electric power from the battery pack 16.

A tool chuck 18 that is rotatably arranged is arranged on the main body 12. The tool chuck 18 allows a screwdriver bit (a screw tightening tool) to be attached to and detached from the tool chuck 18. The tool chuck 18 is rotationally driven by a motor 30 (see FIG. 2) installed inside the main body 12.

A trigger switch 22 is arranged on the main body 12. The trigger switch 22 is arranged on the grip portion 14. The trigger switch 22 is the main switch operated by a user. When a user turns on (pulls) the trigger switch 22, electric power will be supplied to the motor 30 from the battery pack 16, and the tool chuck 18 will be driven by the motor 30. When a user turns off (returns) the trigger switch 22, the supply of electric power to the motor 30 will be halted, and the tool chuck 18 will stop. In addition, the rotational speed of the motor 30 can be adjusted according to the amount that the trigger switch 22 is operated (pulled). In other words, the more the trigger switch 22 is operated, e.g. by further pulling the trigger switch 22, the faster the motor 30 will rotate.

An LED (light emitting diode) 20 for illuminating a working area of the electric screwdriver 10 is arranged on the main body 12. The LED 20 is positioned between the tool chuck 18 and the trigger switch 22. The direction in which the light of the LED 20 shines is set in a direction along the rotational axis of the tool chuck 18. The LED 20 will turn on and turn off in response to the operation of the trigger switch 22.

Figure 3:
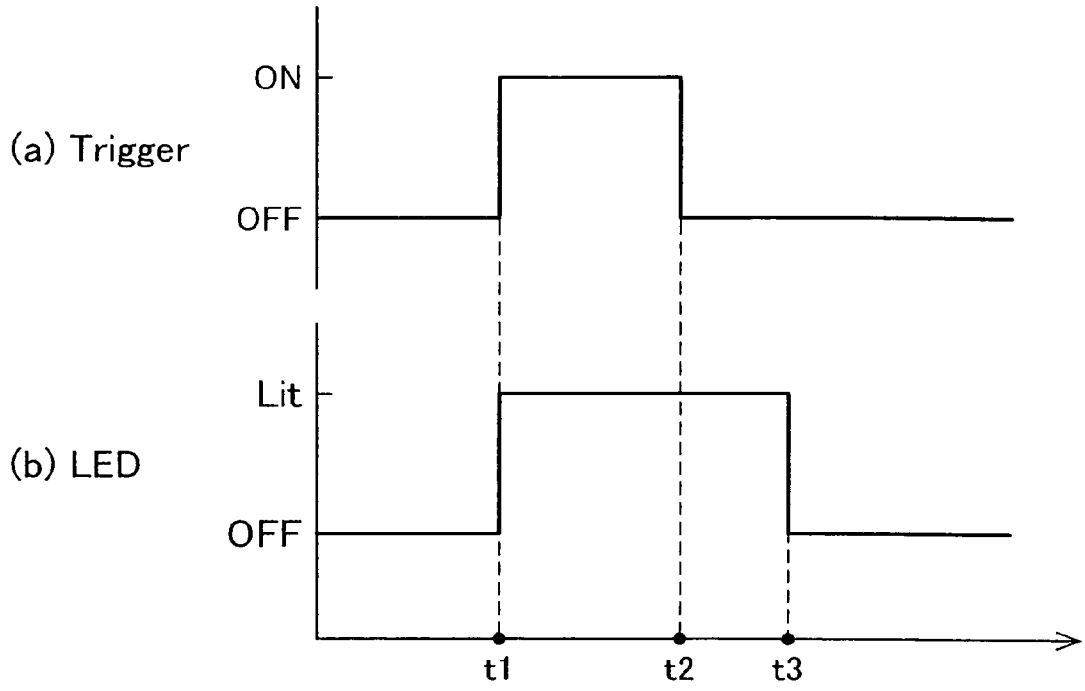
FIG. 3 is a time chart that explains the first lighting mode.
Figure 4:
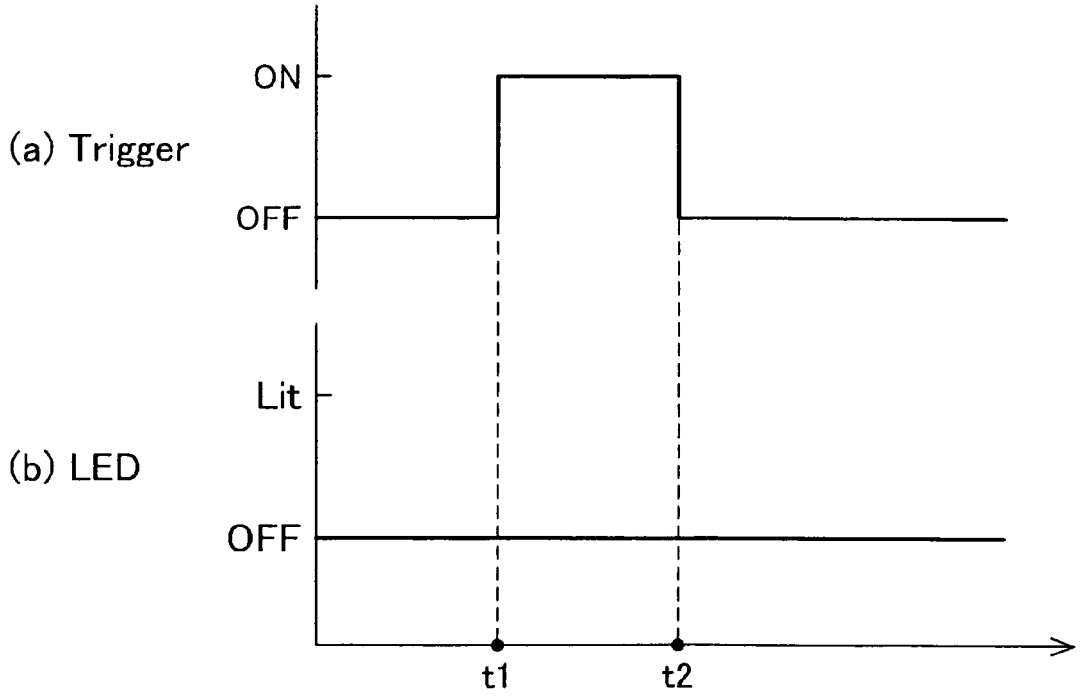
FIG. 4 is a time chart that explains the second lighting mode.

A lighting mode selection switch 24 is arranged on the main body 12. The lighting mode selection switch 24 is a push button type of operating switch that is operated by a user. A user can switch between a first lighting mode and a second lighting mode, which are different operating modes of the LED 20, by operating the lighting mode selection switch 24. As shown in FIG. 3, in the first lighting mode, the illuminator will turn on at time t1 when the trigger switch 22 is turned on, and will turn off at the end of a predetermined afterlight period (time t3) from the point the trigger switch 22 is turned off. In contrast, in the second lighting mode, the LED 20 will remain off regardless of whether the trigger switch 22 is turned on or turned off. In, this configuration, in cases where the working area is bright enough that the LED 20 does not need to be turned on, by switching to the second lighting mode, the LED 20 can be prevented from being needlessly turned on.

A speed selection switch 26 is arranged on the main body 12. The speed selection switch 26 is a push button type of operating switch that is operated by a user. A user can select the rotational speed of the motor 30 (i.e., the rotational speed of the tool chuck 18) in a step-wise manner by operating the speed selection switch 26. In the present embodiment, the rotational speed of the motor 30 (more particularly, the speed when the trigger switch 22 is operated at its maximum) can be switched between 3 levels by operating the speed selection switch 26. In other words, a low speed operating mode, an intermediate speed operating mode, and a high speed operating mode can be selected by operating the speed selection switch 26.

Next, the electrical structure of the electric screwdriver 10 will be explained with reference to FIG. 2. As shown in FIG. 2, the electric screwdriver 10 comprises a motor 30 that drives the tool chuck 18, a regulator 36 that generates a control voltage, and a microcomputer 42 that controls the operation of the motor 30 and the LED 20. The motor 30 is electrically connected to the battery pack 16 via a drive FET (field electric transistor) 32 and a boot FET (field electric transistor) 40. The regulator 36 is electrically connected to the battery pack 16 via the boot FET 40. The LED 20 is electrically connected to the battery pack 16 via a lighting transistor 38.

The trigger switch 22, the light mode selection switch 24, and the speed selection switch 26 noted previously are electrically connected to the microcomputer 42. Note that in FIG. 2, the trigger switch 22 is illustrated as an on/off switch portion 22*a* and a speed adjustment portion 22*b*.

Next, the basic operation of the electric screwdriver 10 will be explained. When the trigger switch 22 is turned on, the gate of the boot FET 40 is connected to ground, and the boot FET 40 is turned on. When the boot FET 40 is turned on, the regulator 36 is electrically connected to the battery pack 16, and the regulator 36 will begin to output a control voltage. When the regulator 36 begins to output the control voltage, electric power will begin to be supplied to the microcomputer 42, and the microcomputer 42 will be booted. Once booted, the microcomputer 42 will turn on the transistor 41 connected to the gate of the boot FET 40, and will maintain the on state of the boot FET 40.

Note that the microcomputer 42 will be booted even if the lighting mode selection switch 24 is operated. As shown in FIG. 2, when the lighting mode selection switch 24 is operated, the gate of the boot FET 40 will be connected to ground, and the boot FET 40 will turn on.

While the trigger switch 22 is turned on, a control voltage will be input to the microcomputer 42 via the transistor 44. The microcomputer 42 will indicate that the trigger switch 22 is turned on, and output a drive signal to the drive FET 32. The drive signal output by the microcomputer 42 will be input to the gate of the drive FET 32. The drive FET 32 will be turned on, and electric power will be supplied from the battery pack 16 to the motor 30. In this configuration, the motor 30 will begin rotation, and the tool chuck 18 will be driven. At this point, the microcomputer 42 can adjust the rotational speed of the motor 30 by pulse width modulation of the drive signal being output. The duty ratio of the drive signal will be determined in response to the amount the trigger switch 22 is operated and the speed that is set with the speed selector switch 26.

When the first lighting mode is selected, the microcomputer 42 will turn on the LED 20 at the point the trigger switch 22 is turned on. In other words, the microcomputer 42 will turn on the lighting transistor 38, and control the battery pack 16 to conduct electricity to the LED 20. In this way, the LED 20 will turn on. The microcomputer 42 will control the LED 20 to remain on while the trigger switch 22 is turned on. Here, the microprocessor 42 can adjust the luminance of the LED 20 by pulse width modulation control of the drive signal being output to the lighting transistor 38. In the present embodiment, the luminance of the LED 20 is set at maximum, and the microcomputer 42 turns on the lighting transistor 38 at a duty ratio of 100%.

In contrast, when the second lighting mode is selected, the microcomputer 42 will not turn on the LED 20 even if the trigger switch 22 is turned on.

Then, when the trigger switch 22 is turned off, the microcomputer 42 will stop the output of the drive signal to the drive FET 32. In this way, the drive FET 32 will turn off, and the rotation of the motor 30 will stop.

When the first lighting mode is selected, the microcomputer 42 will control the LED 20 to remain on even if the trigger switch 22 is turned off. The microcomputer 42 will begin to measure the amount of time from the point that the trigger switch 22 was turned off, and turn off the LED 20 at the point a predetermined afterlight period has expired.

In contrast, when the second lighting mode is selected, the microcomputer 42 will keep the LED 20 turned off even if the trigger switch 22 is turned off.

If, after the trigger switch 22 is turned off, and there has been no operation from the user during a predetermined wait time, the microcomputer 42 will turn off the boot FET 40, and will electrically cut off the regulator 36 from the battery pack 16. In this way, the electric power supply to the microcomputer 42 will be stopped, and the microcomputer 42 will cease operation.

As noted above, with the electric screwdriver 10, a user can, in accordance with his/her need, operate the trigger switch 22 and select a first lighting mode in which the LED 20 is turned on/off, or select a second lighting mode in which the LED 20 remains turned off even if the trigger switch 22 is operated. In the event that the working environment or the work item requires light from the LED 20, the working area can be illuminated while performing the work by selecting the first lighting mode. In this case, it will not be necessary to operate a separate switch in order to turn on and turn off the LED 20. In contrast, in the event that the working environment and the work item do not require light from the LED 20, the LED 20 can be refrained from being turned on by selecting the second lighting mode. In this case, needless electric power consumption by the LED 20 can be prevented.

Next, the control flow of the LED 20 by the microcomputer 42 will be explained with reference to FIG. 5.

Figure 5:
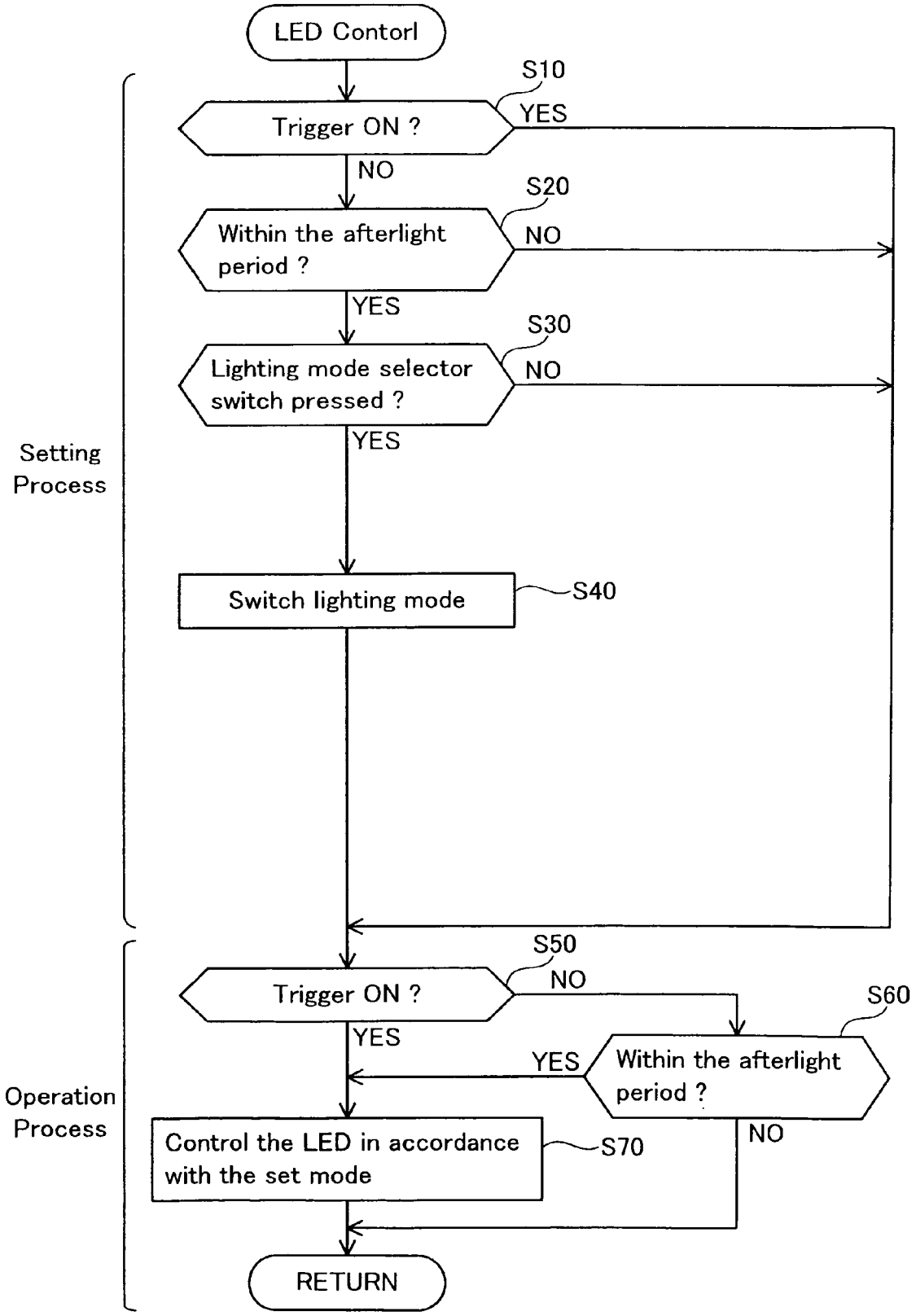
FIG. 5 shows the control flow of an LED by a microcomputer (Embodiment 1).

As shown in FIG. 5, the control flow of the LED 20 is roughly divided into a setting process portion from Step S10 to Step S40, and an operation process portion from Step S50 to Step S70. In the setting process portion, a lighting mode selection process is performed based upon the operation of the lighting mode selector switch 24, and in the operation process portion, the LED 20 is turned on and turned off based upon the lighting mode that was set and the operation of the trigger switch 22.

First, in Step S10, the microcomputer 42 determines whether or not the trigger switch 22 is turned on (pulled). If the trigger switch 22 is turned on, the microcomputer 42 skips the process from Step S20 to Step S40. In this process configuration, if the trigger switch 22 is turned on, selection of the lighting mode with the lighting mode selector switch 24 is prevented. According to the process of Step S10, a sudden switch in the lighting mode during work operation performed by the electric screwdriver 10 will be prevented, and thus will prevent the LED 20 from suddenly turning on or turning off. If the trigger switch 22 is not turned on, the flow proceeds to the process of Step S20.

In Step S20, the microcomputer 42 determines whether or not the current time is within the afterlight period. In other words, the microcomputer 42 determines whether or not the predetermined afterlight period exceeds the current time from the point when the trigger switch 22 was turned off. If the current time is not within the afterlight period, the microcomputer 42 will skip the processes Step S30 and Step S40. If the current time is not within the afterlight period, selection of the lighting mode with the lighting mode selector switch 24 will be prevented. If the current time is within the afterlight period, the flow proceeds to the process of Step S30.

In Step S30, the microcomputer 42 determines whether or not the lighting mode selector switch 24 is turned on (pushed). When the lighting mode selector switch 24 is turned on, a control voltage is input to the microcomputer 42 via the transistor 46. If the lighting mode selector switch 24 is turned on, the microcomputer 42 proceeds to the process of Step S40 and switches the lighting mode. In other words, the microcomputer 42 switches the lighting mode from the first lighting mode to the second lighting mode, or in vice versa, switches the second lighting mode to the first lighting mode. In contrast, if the lighting mode selector switch 24 is not turned on, the microcomputer 42 skips the process of Step S40, and switching of the lighting mode will not occur. The selected lighting mode is stored in the memory of the microcomputer 42. The selected lighting mode is maintained, even if the user does not perform any operation during the stored wait period and the power supply to the microcomputer 42 is automatically stopped.

Here, the lighting mode that was set is stored in the microcomputer 42 in each operation mode selectable by the speed selector switch 26. In this case, when the operation mode is switched by means of the speed selector switch 26, switching of the lighting mode can automatically occur with respect thereto.

In Step S50, the microcomputer 42 determines whether or not the trigger switch 22 is turned on (pulled). If the trigger switch 22 is not turned on, the microcomputer 42 proceeds to the process of Step S60, and if the trigger switch 22 is turned on, the microcomputer 42 proceeds to the process of Step S70.

In Step S60, the microcomputer 42 determines whether or not the current time is within the afterlight period. In other words, the microcomputer 42 determines whether or not the predetermined afterlight period exceeds the current time from the point that the trigger switch 22 was turned off. If the current time is within the afterlight period, the microcomputer 42 proceeds to Step S70. In contrast, if the current time is not within the afterlight period, the microcomputer 42 returns to the process of Step S10 without turning on the LED 20. In other words, if the trigger switch 22 is not turned on and the current time is not within the afterlight period, the LED 20 will not be turned on, regardless of the lighting mode that was set.

In Step S70, the microcomputer 42 turns on the LED 20 in response to the lighting mode that had been set previously. In other words, when the first lighting mode is set, the microcomputer 42 turns on the LED 20. In contrast, when the second lighting mode is set, the microcomputer 42 will not turn on the LED 20. After the process of Step S70, the flow returns to Step S10, and the aforementioned processes will be repeatedly executed.

According to the aforementioned control flow, when the first lighting mode is set, the LED 20 is turned on at the point when the trigger switch 22 is turned on, and the LED 20 will be turned off at the end of the afterlight period from the point the trigger switch 22 has been turned off. The LED 20 is turned off based on a determination on whether the afterlight period has elapsed. In contrast, when the second lighting mode is set, the LED 20 will remain off regardless of whether the trigger switch 22 is turned on or turned off.

According to the aforementioned control flow, changes to the lighting mode are restricted to be performed within the afterlight period (see Step S20 of FIG. 5). Thus, switching of the lighting mode must occur within the afterlight period. When a mode switch to the first lighting mode has occurred in Step S40 in FIG. 5, Step S50 will be NO, Step S60 will be YES, and then the flow will proceed to Step S70, at which time the microcomputer 42 will turn on the LED 20. In other words, when the first lighting mode has been selected by means of the lighting mode selection switch 24, the LED 20 will be turned on. In contrast, when the second lighting mode has been selected, the LED 20 will not be turned on in the process of Step S70. Thus, when a user switches the lighting mode by means of the lighting mode selection switch 24, the user can know whether the lighting mode has been switched to the first lighting mode or the second lighting mode by confirming that the LED 20 is turned on or turned off during his/her operation for the mode switch.

The electric screwdriver 10 of the present embodiment is not limited to having only a first lighting mode and a second lighting mode; and as such, a variety of lighting modes can also be provided. In this case, with an additional third lighting mode, it is preferable that the LED 20 will be turned on when the set mode is switched to the third lighting mode, and turned off at the end of a predetermined lighting period from the point of mode switching. By providing this third lighting mode, it will be possible for a user to turn on the LED 20 by operating the lighting mode selection switch 24, and without operating the trigger switch 22. In other words, a user can turn on the LED 20 without needlessly rotating the motor 30. Furthermore, because the LED 20 is automatically turned off after the predetermined lighting period has elapsed, an operation to turn off the LED 20 will not be needed, and the needless consumption of electrical power due to a user forgetting to turn off the LED 20 will be prevented.

Embodiment 2

An electric screwdriver of Embodiment 2 will be explained with reference to the drawings. The electric screwdriver of Embodiment 2 is different from the electric screwdriver 10 of Embodiment 1 in view of the control flow for the LED 20 by the microcomputer 42. The control flow of this embodiment is shown in FIG. 6.

Figure 6:
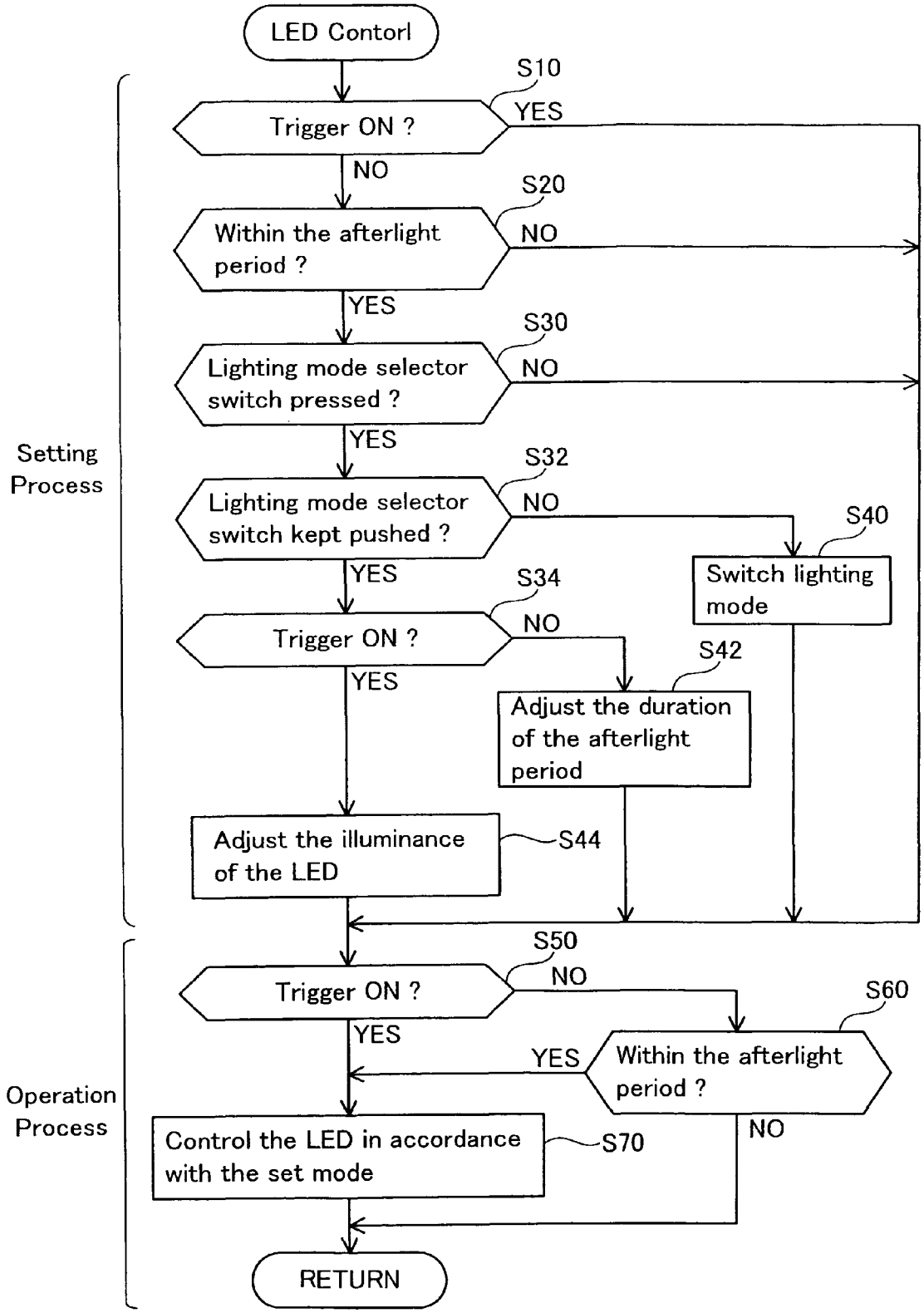
FIG. 6 shows the control flow of an LED by a microcomputer (Embodiment 2).

In the control flow of Embodiment 2 shown in FIG. 6, when compared to the control flow of Embodiment 1 shown in FIG. 5, the processes of Step S32, Step S34, Step S42, and Step S44 have been added to the setting process portion. With the electric driver of Embodiment 2, a user can change the afterlight period in the first lighting mode (the period in which the LED 20 remains on after the trigger switch 22 is turned off), as well as the luminance of the LED 20. The control flow executed by the microcomputer will be explained below, with emphasis on the processes related to the change in the afterlight period and the change in luminance.

In the control flow of the present embodiment, when the microcomputer 42 determines that the lighting mode selection switch 24 is turned on (i.e., pressed) in Step S30, the microcomputer 42 will proceed to the process of Step S32.

In Step S32, the microprocessor 42 determines whether or not the lighting mode selection switch 24 is kept continuously operated (i.e., being pressed over a certain long period of time). If the lighting mode selection switch 24 has been pressed for over a certain period of time, the microcomputer 42 proceeds to the process of Step S34. In contrast, if the lighting mode selection switch 24 has not been pressed for over the certain period of time, the microcomputer 42 proceeds to the process of Step S40, and the microcomputer 42 switches the lighting mode. In other words, if the lighting mode selection switch 24 is not being pressed for over a predetermined long period of time, the same process as in Embodiment 1 (cf. S40 and on in FIG. 5) will be executed.

In Step S34, the microcomputer 42 determines whether or not the trigger switch 22 is turned on (pulled). If the trigger switch 22 is not turned on, the microcomputer 42 proceeds to the process of Step S42. If the trigger switch 22 is turned on, the microcomputer 42 proceeds to the process of Step S44.

In Step S42, the microcomputer 42 carries out a process to change the afterlight period. At this point, the microcomputer 42 changes the duration of the afterlight period in accordance with the length of time the lighting mode selection switch 24 has been pressed. In other words, the longer the lighting mode selection switch 24 is kept pressed, the longer the afterlight period will be. The microcomputer 42 stores the post-change afterlight period in the internal memory.

In contrast, in Step S44, the microcomputer 42 carries out a process to change the luminance of the LED 20. At this point, the microcomputer 42 changes the degree of luminance of the LED 20 in accordance with the amount the trigger switch 22 is operated (the amount of pull). In other words, the more the trigger switch 22 is operated, the greater the luminance of the LED 20 will be. Here, as explained above, the setting of the luminance of the LED 20 is performed by means of the duty ratio when the lighting transistor 38 is turned on. The microcomputer 42 stores the post-change luminance in internal memory.

Note that with the setting of the luminance of the LED 20, the control program can also be set up so as to employ the amount of time the trigger switch 22 is operated (the amount of time it is pulled) rather than the amount the trigger switch 22 is operated.

According to the aforementioned control flow, with the electric screwdriver of Embodiment 2, the afterlight period of the LED 20 can be changed by pressing the light mode selection switch 24 for a long period of time. In addition, the luminance of the LED 20 can be changed by pressing the light mode selection switch 24 for a long period of time, and turning on the trigger switch 22. Because the post-change afterlight period and luminance is stored by the microcomputer 42, it will not be necessary to reset the afterlight period and luminance each time the electric screwdriver 10 is to be used. Here, the microcomputer 42 preferably stores the set afterlight period and luminance respectively for the low speed operating mode, the intermediate speed operating mode, and the high speed operating mode. In this case, the afterlight period and luminance can be suitably set in accordance with each operating mode.

With the aforementioned control flow, the positions of the process of adjusting the afterlight period in Step S42 and the process of adjusting the luminance in Step S42 within the control flow can also be exchanged. In this way, the luminance of the LED 20 can be adjusted by pressing the light mode selection switch 24 for a certain period of time, and still not turning on the trigger switch 22. In addition, the afterlight period of the LED 20 can be adjusted by pushing the light mode selection switch 24 for a certain period of time, and also turning on the trigger switch 22.

For example, if the aforementioned third lighting mode is added to the electric screwdriver of Embodiment 2, it is preferable that the process of adjusting the aforementioned afterlight period and the luminance be possible for each lighting mode. In other words, if the aforementioned afterlight period and luminance were adjusted in a state in which the first lighting mode is selected, only the afterlight period and luminance in the first lighting mode should be adjusted. In contrast, if the aforementioned afterlight period and luminance were adjusted in a state in which the third lighting mode is selected, only the afterlight period and luminance in the third lighting mode should be adjusted. Thus, the afterlight period set in each lighting mode (the afterlight period after the trigger switch 22 is turned off) is preferably stored for each lighting mode by the microcomputer 42.

Specific embodiments of the present teachings are described above, but that merely illustrates some possibilities of the teachings and does not restrict the claims thereof. The art set forth in the claims includes variations and modifications of the specific examples set forth above.

The technical elements disclosed in the specification or the drawings may be utilized separately or in all types of combinations, and are not limited to the combinations set forth in the claims at the time of filing of the application. Furthermore, the art disclosed herein may be utilized to simultaneously achieve a plurality of aims or to achieve one of these aims.

What is claimed is:

1. A power tool comprising:

a prime mover that drives a tool;

a main switch that causes the prime mover to operate when the main switch is activated and causes the prime mover to stop operating when the main switch is deactivated;

at least one illuminator that lights a working area of the tool;

a lighting mode selector switch that is configured to be operated by a user independently from the main switch to selectively switch a lighting mode of the illuminator among a plurality of lighting modes, the plurality of lighting modes including at least a first lighting mode, a second lighting mode, and a third lighting mode; and a controller that is configured to:

allow the lighting mode selector switch to change the lighting mode when the lighting mode selector switch is operated while the main switch remains deactivated, forbid the lighting mode selector switch to change the lighting mode while the main switch is activated even when the lighting mode selector switch is operated, and control the at least one illuminator in accordance with the lighting mode selected with the lighting mode selector switch, wherein when the first lighting mode is selected, the controller turns on and off the at least one illuminator in accordance with activation and deactivation, respectively, of the main switch, when the second lighting mode is selected, the controller keeps the at least one illuminator turned off regardless of the activation and deactivation of the main switch, when the third lighting mode is selected, the controller turns on the at least one illuminator at the time that the third lighting mode is selected, and the controller comprises a microcomputer that is configured to begin a setting process to enable the lighting mode selector switch to change the lighting mode of the at least one illuminator when the main switch is activated.

2. The power tool as set forth in claim 1, wherein when the first lighting mode is selected, the at least one illuminator is turned on at the point when the main switch is activated and turned off at the end of a first predetermined period from when the main switch is deactivated.

3. The power tool as set forth in claim 2, wherein a duration of the first predetermined period is adjusted with the lighting mode selector switch.

4. The power tool as set forth in claim 3, wherein the duration of the first predetermined period is adjusted in accordance with an amount of time that the lighting mode selector switch is continuously operated.

5. The power tool as set forth in claim 2, wherein the duration of the first predetermined period is adjusted in accordance with an amount of time the lighting mode selector switch is continuously operated.

6. The power tool as set forth in claim 1, wherein, when the third lighting mode is selected, the at least one illuminator is turned off at the end of a second predetermined period from when the third lighting mode is selected.

7. The power tool as set forth in claim 1, wherein a luminance of the at least one illuminator is adjusted with the lighting mode selector switch.

8. The power tool as set forth in claim 7, wherein the luminance of the at least one illuminator is adjusted in accordance with an amount of time the lighting mode selector switch is continuously operated.

9. The power tool as set forth in claim 1, further comprising:

a mode indicating device that indicates selection of the first lighting mode when the first lighting mode is selected with the lighting mode selector switch.

10. The power tool as set forth in claim 9, wherein the mode indicating device turns on the at least one illuminator when the first lighting mode is selected.

11. The power tool as set forth in claim 1, further comprising:

a storage device that stores the lighting mode selected with the lighting mode selector switch.

12. The power tool as set forth in claim 11, further comprising:

a speed selector switch configured to switch an operating speed of the prime mover between a plurality of predetermined operating speeds, wherein the storage device stores, for each operating speed that is selected with the speed selector switch, the lighting mode selected with the lighting mode selector switch.

13. A power tool comprising:

a prime mover that drives a tool;

a main switch that causes the prime mover to operate when the main switch is activated and causes the prime mover to stop operating when the main switch is deactivated;

at least one illuminator that lights a working area of the tool;

a lighting mode selector switch that is configured to be operated by a user independently from the main switch to selectively switch a lighting mode of the at least one illuminator among a plurality of predetermined lighting modes, the plurality of predetermined lighting modes including at least a first lighting mode, a second lighting mode, and a third lighting mode; and a controller that is configured to control the at least one illuminator in accordance with the lighting mode selected with the lighting mode selector switch, wherein when the first lighting mode is selected, the controller turns on and off the at least one illuminator in accordance with activation and deactivation, respectively, of the main switch, when the second lighting mode is selected, the controller keeps the at least one illuminator turned off regardless of the activation and deactivation of the main switch, when the third lighting mode is selected, the controller turns on the at least one illuminator when the third lighting mode is selected, and the controller comprises a microcomputer configured to begin a setting process to enable the lighting mode selector switch to change the lighting mode of the at least one illuminator when the main switch is activated.

14. The power tool as set forth in claim 13, wherein the microcomputer is configured to automatically quit the setting process when there is no operation to the main switch during a predetermined wait period.

15. The power tool as set forth in claim 14, wherein the microcomputer comprises a memory configured to store the lighting mode that is selected such that the selected lighting mode is maintained.

16. The power tool as set forth in claim 13, wherein when the third lighting mode is selected, the at least one illuminator is turned off at the end of a second predetermined period from when the third lighting mode is selected.

17. A power tool comprising:

a prime mover that drives a tool;

a main switch that causes the prime mover to operate when the main switch is activated and causes the prime mover to stop operating when the main switch is deactivated;

at least one illuminator that lights a working area of the tool; and a lighting mode selector switch that is configured to be operated by a user independently from the main switch to selectively switch a lighting mode of the illuminator among a plurality of predetermined lighting modes, the plurality of predetermined lighting modes including at least a first lighting mode, a second lighting mode, and a third lighting mode, wherein when the first lighting mode is selected, the at least one illuminator is turned on and off in accordance with activation and deactivation, respectively, of the main switch, when the second lighting mode is selected, the at least one illuminator is kept turned off regardless of the activation and deactivation of the main switch, when the third lighting mode is selected, the at least one illuminator is turned on at the time that the third lighting mode is selected, and the lighting mode selector switch is configured to become able to change the lighting mode of the at least one illuminator after the main switch is activated.

18. The power tool as set forth in claim 17, wherein the lighting mode selector switch is configured to become unable to change the lighting mode of the at least one illuminator after a predetermined wait period during which there is no operation of the main switch.

* * * * *